US006390771B1

(12) United States Patent
Gervais et al.

(10) Patent No.: US 6,390,771 B1
(45) Date of Patent: May 21, 2002

(54) HIGH-PRESSURE COMPRESSOR STATOR

(75) Inventors: Pascal Gérard Gervais, Melun; Pascal Michel Daniel Lejeune, Avon; Carmen Miraucourt, Brie Comte Robert; Jacky Serge Naudet, Bondoufle; Patrice Suet, Montgeron; Monique Andrée Thore, Crosne, all of (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 09/586,791

(22) Filed: Jun. 5, 2000

(30) Foreign Application Priority Data

Jun. 10, 1999 (FR) ..... 99 07315

(51) Int. Cl.[7] ..... F01D 25/14

(52) U.S. Cl. ..... 415/139; 415/144; 415/176; 415/178; 415/173.1; 415/200

(58) Field of Search ..... 415/144, 145, 415/116, 138, 139, 176–178, 200, 134, 173.1

(56) References Cited

U.S. PATENT DOCUMENTS

| | | | | |
|---|---|---|---|---|
| 3,854,843 A | | 12/1974 | Penny | |
| 4,101,242 A | | 7/1978 | Coplin et al. | |
| 4,578,942 A | | 4/1986 | Weiler | |
| 4,805,398 A | | 2/1989 | Jourdain et al. | |
| 5,127,794 A | | 7/1992 | Burge et al. | |
| 5,160,241 A | | 11/1992 | Glynn | |
| 5,314,303 A | | 5/1994 | Charbonnel et al. | |
| 5,320,484 A | * | 6/1994 | Charbonnel et al. | 415/134 |
| 5,351,478 A | * | 10/1994 | Walker et al. | 415/144 |
| 5,553,999 A | * | 9/1996 | Proctor et al. | 415/173.1 |
| 5,653,581 A | * | 8/1997 | Dixon et al. | 415/134 |
| 6,109,868 A | * | 8/2000 | Bulman et al. | 415/144 |

FOREIGN PATENT DOCUMENTS

| | | | | |
|---|---|---|---|---|
| DE | 1285255 A | * | 12/1968 | 415/138 |

* cited by examiner

*Primary Examiner*—Christopher Verdier
(74) *Attorney, Agent, or Firm*—Oblon, Spivak, McClelland, Maier & Neustadt, P.C.

(57) ABSTRACT

A stator suitable for high-pressure compressors in gas turbine engines includes two points of ventilation at different temperatures. It is recommended that the upstream section of the stator be constructed with a casing and a shroud, both of which are unbroken around a circumference and made of a material with a low degree of thermal expansion. Downstream the shroud is, however, constructed using angular sectors in a material with a higher degree of thermal expansion.

8 Claims, 5 Drawing Sheets

HIGH-PRESSURE COMPRESSOR STATOR

FIELD OF THE INVENTION

The present invention relates to a stator with a uniform structure capable of being applied to high-pressure compressors in gas turbine engines.

DISCUSSION OF THE BACKGROUND

The structure of the rotor and stator in gas turbine engines is often cooled or ventilated by air drawn from the flow that runs through the machine. Double ventilation may even be used in conjunction with two sources of drawn-off air or a downstream section of the stator and rotor can be ventilated after the stator and rotor have been initially ventilated further upstream. The air that is drawn off for the downstream ventilation comes from a section of the machine where it has already been compressed, thereby heating it to a higher temperature than the upstream ventilation air. The usual problem of obtaining a correct setting of the diameters of the stator and rotor in order to avoid an excessive increase in play at the end of the blades, which would increase the air leaks and loss of efficiency or, on the contrary, would eliminate the play and cause the rotor blades to rub against the stator, then becomes extremely difficult to solve due to the uneven conditions of ventilation. These conditions create different temperatures and thermal expansions between the sections that are subjected respectively to the two sources of ventilation. Another problem arises out of the fact that the various sections of the machine, including those that are located close to the compressor, are heated to different temperatures depending on whether they are near the ventilation air or the hotter air of the flow jet. This results in unequal expansions, distortions and stresses within the stator. Variations in temperature occur more quickly in certain zones such that the above problems can become more or less serious locally during phases of speed change. No known stator structure is completely satisfactory under these conditions.

SUMMARY OF THE INVENTION

The invention consists in dividing the stator structure on either side of the junction of the ventilation zones and of constructing the stator differently between the sections subjected to upstream ventilation and those subjected to downstream ventilation. In its most general form the invention consists in a compressor stator provided with upstream ventilation and downstream ventilation of air that is hotter than the upstream ventilation. It also comprises a shroud surrounding a gas flow jet, characterized in that it comprises a first section of shroud, which is subjected to the upstream ventilation, with an unbroken annular construction around a circumference and that is made of a first material, and a second section of shroud, which is subjected to the downstream ventilation, with a structure comprising juxtaposed angular sectors made of a second material the coefficient of expansion of which is higher than that of the first material.

The first and second materials can be selected respectively from among materials with lower coefficients of expansion, such as TA6V and titanium alloys, INC0909, TiAL or similar intermetallics with an average coefficient of linear expansion lower than $10.10^{-6}$ m per degree Celsius; and from among materials with higher coefficients of expansion, such as INC0718 or similar nickel-based alloys, RENE77 and derivatives with an average coefficient of linear expansion of approximately $15.10^{-6}$ m per degree Celsius.

BRIEF DESCRIPTION OF THE DRAWINGS

A more detailed description of the invention, its characteristics, aims and advantages will be given referring to the figures of which.

Figure 1:
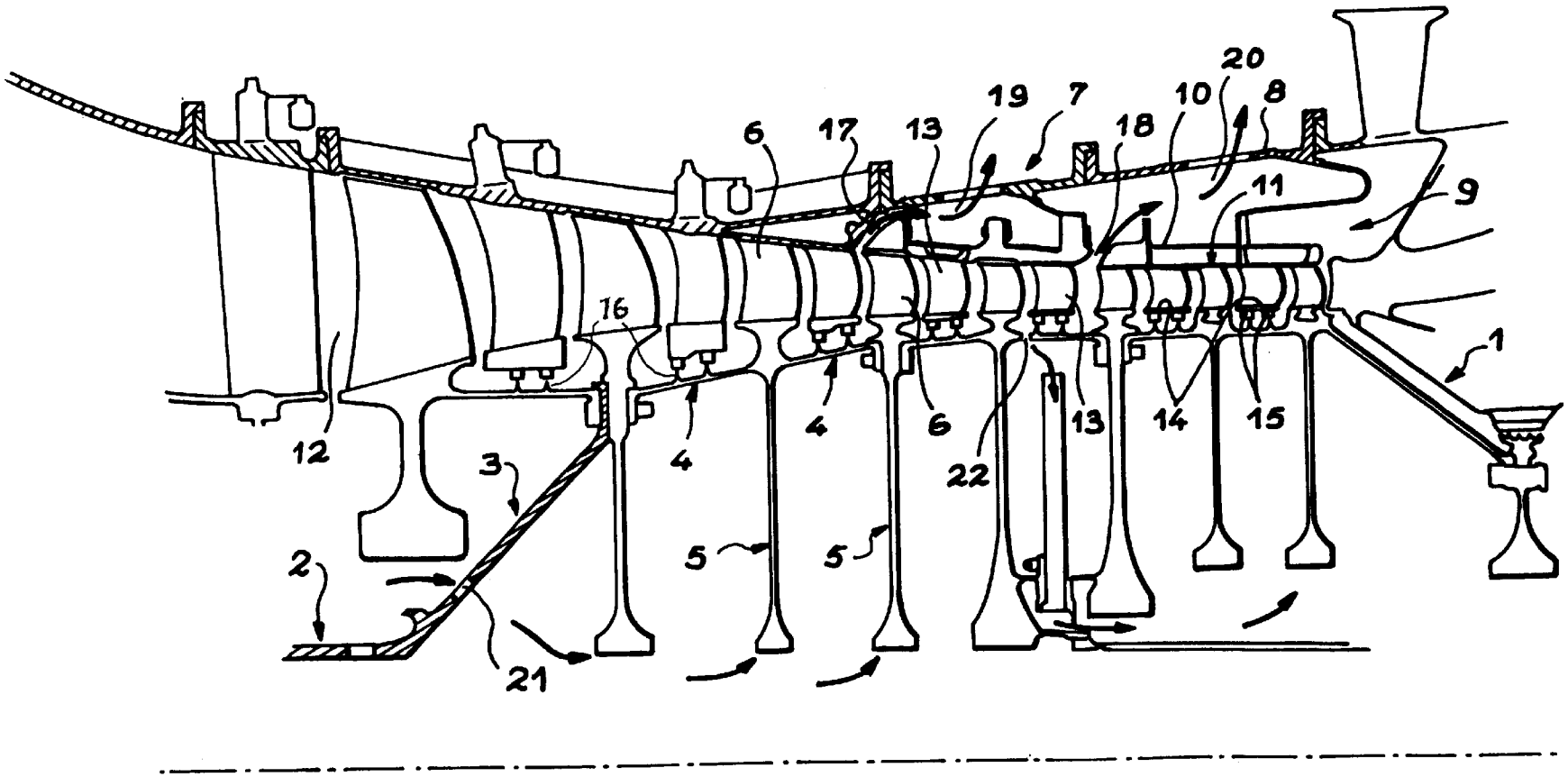
FIG. 1 is a view of a high-pressure compressor of a gas turbine engine.

A high-pressure compressor, such as that shown in FIG. 1, comprises a central rotor 1 driven by a line of shafts 2 and is composed of a streamlined envelope 3 consisting of rings 4 that are juxtaposed and separated by discs 5 at right angles to stages of mobile blades 6. A stator 7 surrounds rotor 1 and comprises, in the inner lining of a body 8, a section 9 to which the invention relates and that is constituted by a support casing 10 and a shroud 11 that is supported by casing 10 and turned towards rotor 1 and that defines an annular gas flow jet 12. Stages of mobile blades 6 and stages of immobile blades 13 are positioned in said gas flow jet to rectify the flow, said immobile blade stages being connected to shroud 11 and alternating with the stages described above. Usually the ends of immobile blades 13 located forward of envelope 3 of rotor 1 bear connecting rings 14 that are provided with circular strips of material called "abradable" 15 that has a honeycomb structure or that, more generally, is easily eroded. The structure is hollowed out by ribs 16 that stand erect opposite envelope 3 with which they constitute a leaktight labyrinth seal. However, the ends of mobile blades 6 are not fitted with any components and finish close to shroud 11.

There are discontinuities in internal section 9 of stator 7 that constitute openings for drawing air from jet 12. These openings are referred to as 17, 18 in the figure. These openings open into chambers 19 and 20 respectively located between section 9 and body 8. Air drawn from jet 12 passes through these chambers mainly to ventilate casing 10 and to subject it to a determined temperature and thermal expansion. The inside of rotor 1 is also ventilated, first through a hole 21 pierced in envelope 3 located upstream of rotor 1 through which cool air, more or less at the same temperature as that which enters chamber 19, is drawn in, and by another hole 22 pierced in envelope 3 at more or less right angles to second opening 18. Chambers 19 and 20 divide stator 7 into two ventilation zones in front of which they are respectively positioned and that are located on either side of the inlet opening 19 in downstream chamber 20 that divides section 9 in two. Two ventilation zones in similar positions exist on rotor 1 on either side of hole 22.

Figure 2:
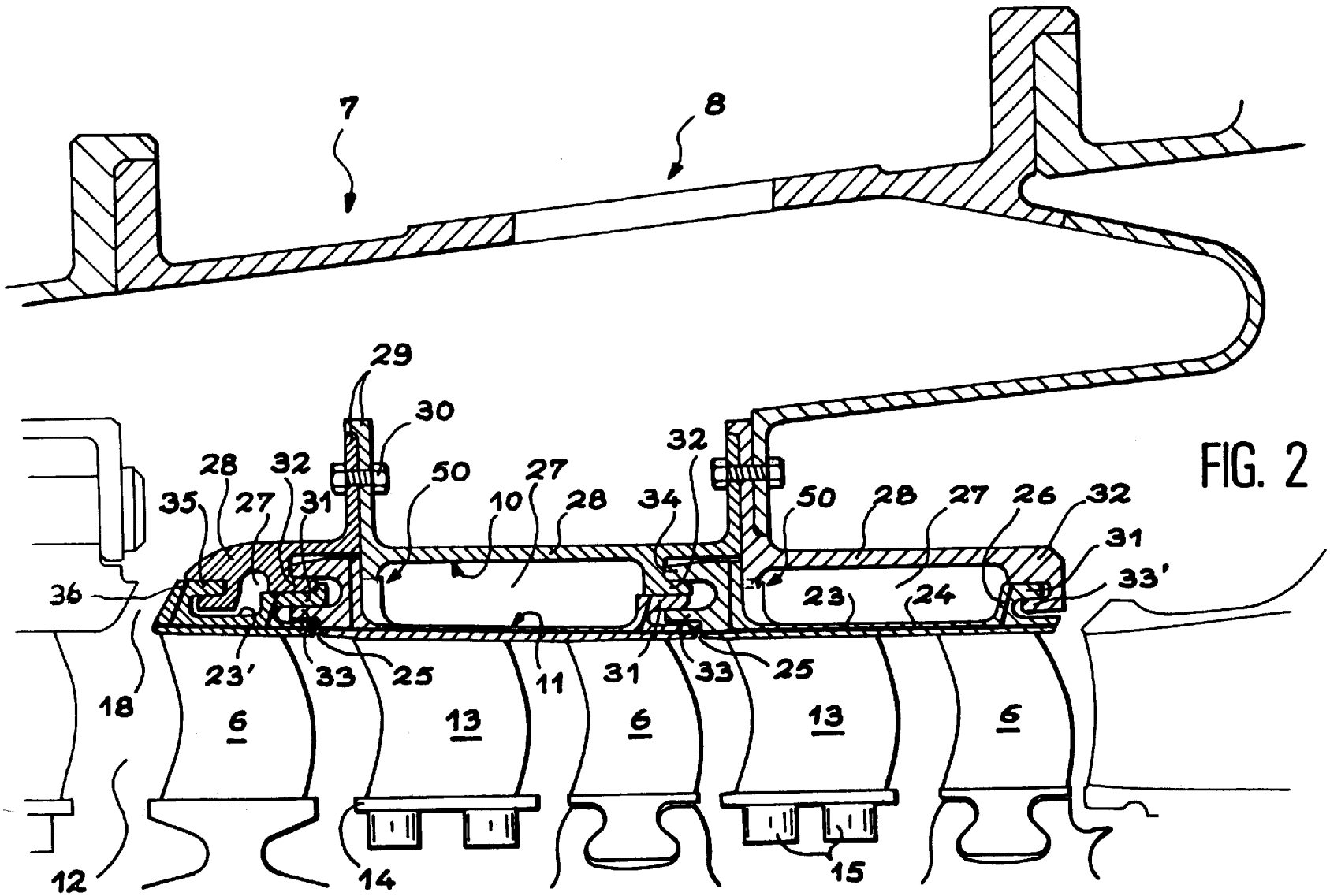
FIG. 2 is an enlarged view of the downstream section of the stator in the compressor.
Figure 3:
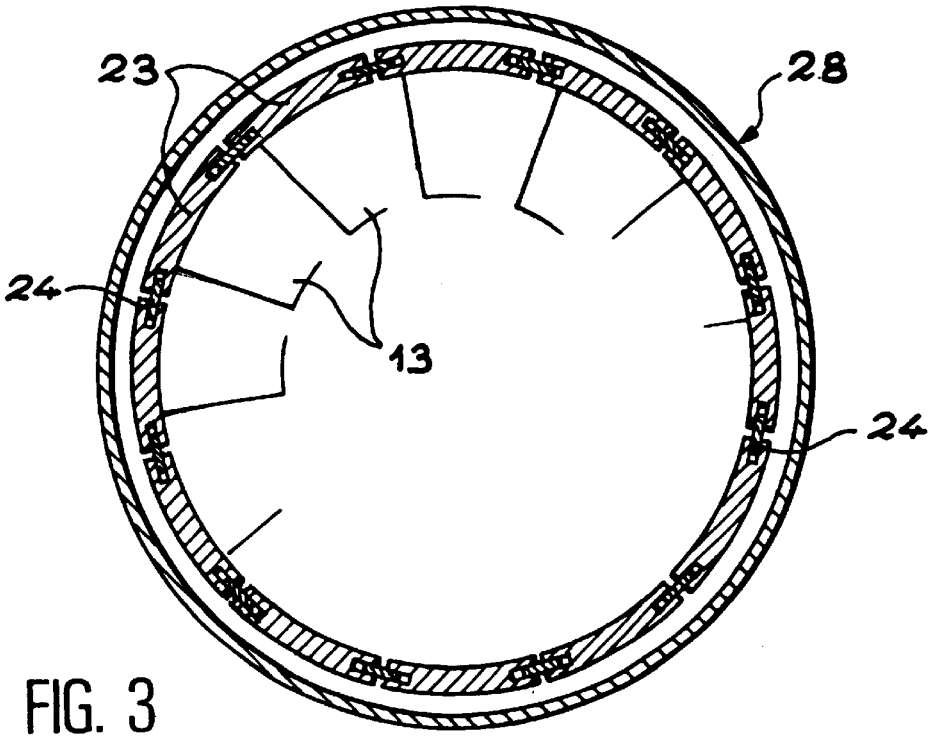
FIGS. 3 and 4 are cross-sections of the upstream and downstream sections, respectively, of the compressor.

Despite the precautions taken to equalize the thermal expansions between the various sections of rotor 1 and stator 7, particularly by ensuring they both have identical conditions of ventilation, experience has proved that it is extremely difficult to achieve satisfactory operating conditions that only allow moderate play to exist between mobile blades 6 and shroud 11. The problem is more serious in the downstream section in which the hotter air circulates and that is also subjected to hotter ventilation. Shroud 11 (FIGS. 2 and 3) should therefore be constructed as sectors 23, of which there may be a variable number around a circumference (for example ten), and the longitudinal extension of which may also be variable.

The present example comprises two circles of sectors 23 that constitute a forward section of immobile blade support 13 and a rear section located at right angles to a stage of mobile blades 6. A third circle of sectors 23' also exists that is shorter and that only comprises a section opposite a stage of mobile blades 6. Adjacent sectors 23 and 23' are connected by flexible leaktight tabs 24, positioned in longitudinal grooves on the edges of the sectors, the ends 25 of which are connected together, between the circles of consecutive sectors 23 and 23'. The adjacent sectors are also connected by other flexible tabs 26 provided in the grooves that are purely or obliquely radial to the edges of sectors 23 and 23' and that extend from the first tabs 24 to casing 10. This arrangement is effective in preventing the gas, which 5 is very hot at this point, from jet 12 from leaking between sectors 23 and 23' and reaching casing 10 and possibly damaging it.

In particular, it should be pointed out that tabs 24 and 26 insulate empty volumes 27, which could also be filled with a heat-insulator, that appear between each of the circles of sectors 23 and 23' and rings 28 connected to casing 10. Casing 10 is therefore only exposed to the air that enters forward chamber 20 while shroud 11 is only exposed to the air from jet 12. Successive rings 28 are connected to each other and to body 8 with flanges 29, with which they end, that are fastened together with bolts 30.

Figure 2A:
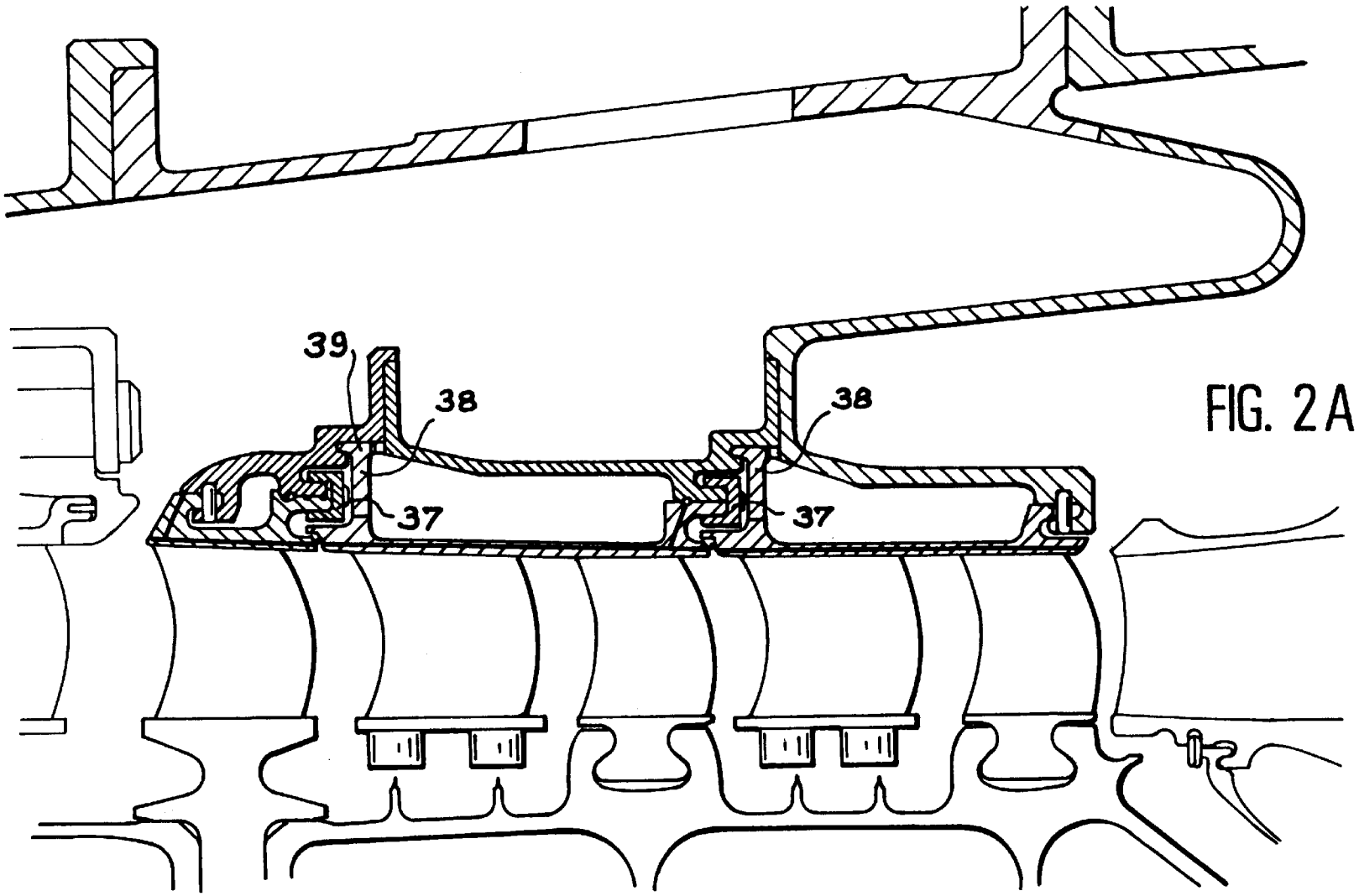
FIG. 2A is a similar view of another possible embodiment of the invention.

The method used to connect and assemble sectors 23 and 23' is also of interest. Each sector comprises a rear lip 31 that projects inwards and to the rear and that is gripped between a lip 32 of one of rings 28, located radially towards the exterior, and a lip 33 or 33' pointing towards the fore and that is situated either forward of the sectors 23 or forward of ring 28 located further downstream; and sectors 23 and 23' comprise another outer lip 34 at the fore that operates in conjunction with lips 33 to grip between them lips 31 and 32 directed towards the rear. Sectors 23' differ in that they only comprise a single lip at the fore. This lip 35 is directed towards the rear and is housed in a groove 36 in ring 28 located the furthest to the fore. This method of assembly is simpler than the more standard design of fastening shroud rings shown in FIG. 2A, in which lips 31 and 32 are connected by separate seals 37 that have staple-type cross-sections and in which the parts of the shroud comprise a relatively high rib 38 that ends in a lip 39 directed towards the fore and that is housed in a groove of the adjacent ring. Nevertheless, this less favorable design may be adopted if preferred. Whichever arrangement is chosen, systems 50 of interlocking tenons enable sectors 23 and 23' to be connected to rings 28 in an angular direction and a number of embodiments will be possible to a person skilled in the art.

The construction of shroud 11 in angular sectors 23 and 23' avoids significant stresses being created around the circumference due to the temperature of shroud 11 increasing quicker than that of casing 10. The larger expansions, to which shroud 11 is nevertheless subjected, result simply in a reduction in the play between angular sectors 23 and 23' and in flexible tabs 24 and 26 possibly bending. The risk of shroud 11 being irregularly distorted by becoming oval-shaped or undulating, eventually leading to variable play at the end of mobile blades 6, or even shroud 11 rubbing against casing 10 following excessive radial expansion, is therefore avoided. The method used to connect sectors 23 and 23' to rings 28 is sufficiently flexible and absorbs the distortions without receiving any significant stresses. Rings 28 are preferably unbroken around the circumference to give a simpler structure and improved mechanical resistance. Furthermore, rings 28, like sectors 23 and 23', should be made of a material with a high coefficient of expansion, i.e. a material that is a good heat conductor in order for it to be subjected as quickly as possible to the expansions caused by heating during changes of speed. It is recommended that rotor 1 be made of the same material as rings 28 of stator 7. INC0718 or a similar nickel-based alloy with a high coefficient of expansion may be used for this downstream section of the compressor.

Figure 4:
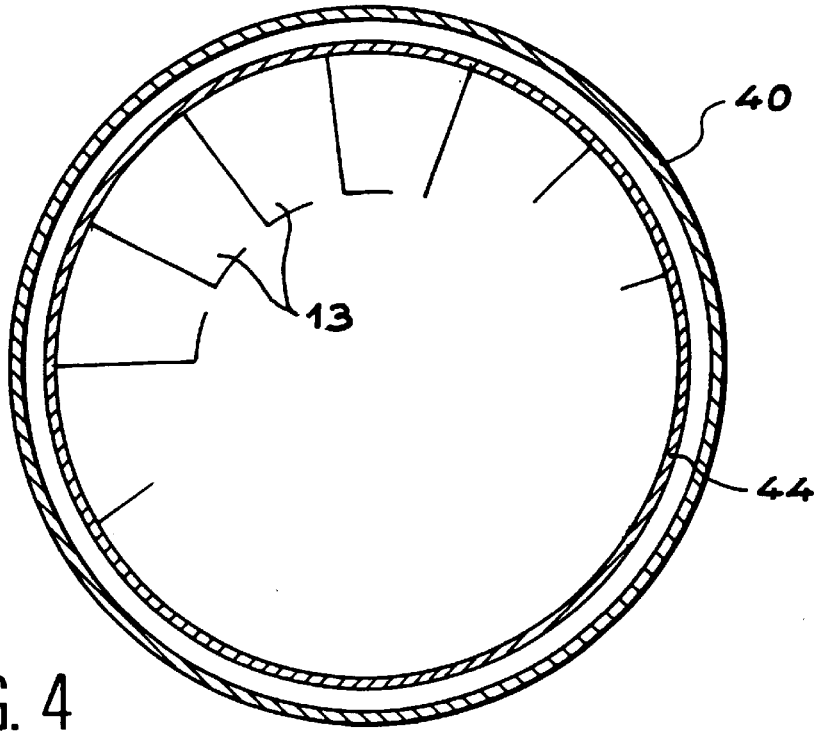
Figure 5:
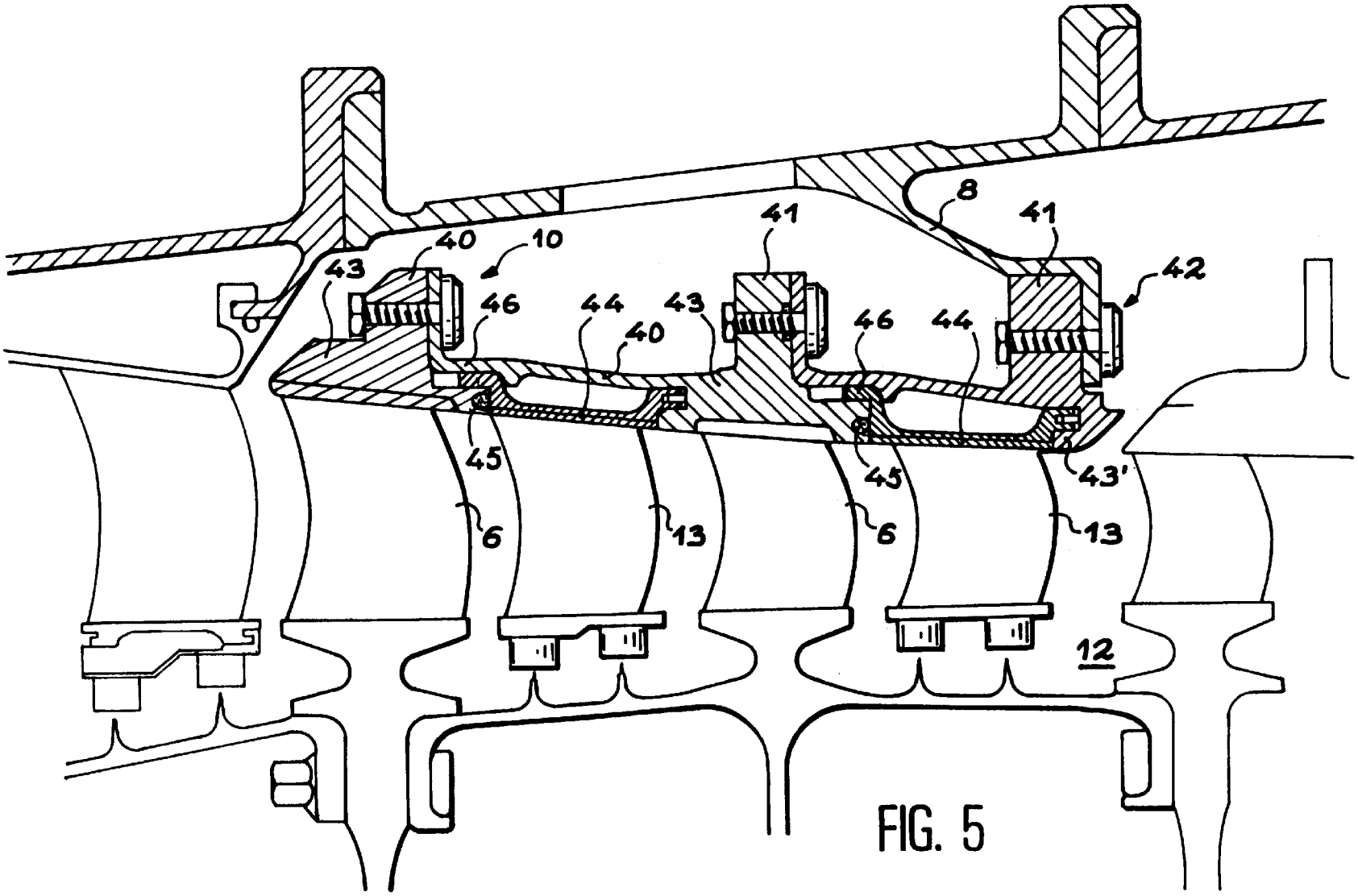
FIG. 5 is an enlarged view of the upstream section of the invention.

The upstream section of stator 7 has a different structure, as shown in FIGS. 4 and 5, due to the slight temperature variations to which it is subjected. In this region casing 10 consists of rings 40 that are connected together by bolts 42 that grip flanges 41 with which they end as well as body 8, similarly to rings 28; these rings 40, however, also comprise protuberances 43 and 43' that extend radially inside and that open onto air flow jet 12 and that are therefore exposed to its temperature. Two of these protuberances 43 are sufficiently wide to extend opposite a respective stage of mobile blades 6.

In this example shroud 11 is constituted by both protuberances 43 and 43' and by support rings 44 of immobile blades 13; rings 44 finish in the fore and at the rear in lips 45 that enter the grooves of protuberances 43 and 43'. Mechanical systems 46 of interlocking tenons connect rings 40 to concentric rings 44 and prevent them from rotating relative to one another. The main difference compared to the downstream design is that rings 44 are unbroken around a circumference, similarly to rings 40. As the heating is lower upstream and as the differences in temperature between casing 10 and shroud 11 are also lower, it is simpler and more advantageous to have a similar structure for both, thereby limiting the risk of distortion and excessive stress. Furthermore, the coefficient of expansion of the material used should be lower than that of the material used to construct the downstream section of the casing. This is because the slower expansions to which these materials are subjected have a slight regularizing effect on the development of the expansion during the transient phases and provide better control of the play at the end of the mobile blades 6. An Inconel 909 or similar alloy or a TiAl or similar intermetallic may be recommended. Again, rotor 1 can be made of a material the coefficient of expansion of which is similar to that used for the matching stator rings 40, for example a titanium alloy.

What is claimed is:

1. A compressor stator provided with upstream ventilation and downstream ventilation that is hotter than the upstream ventilation, comprising a shroud that surrounds a gas flow jet, which comprises a first section of shroud subjected to the upstream ventilation, said first section having an unbroken annular structure around a circumference thereof and being made of a first material, and a second section of shroud subjected to the downstream ventilation, said second section comprising juxtaposed, angular sectors made of a second material having a coefficient of expansion of which is higher than that of the first material.

2. The stator of claim 1 wherein the first materials comprise materials selected, respectively, from a group of materials with lower coefficients of expansion, consisting of TA6V and titanium alloys, INC0909, TiAL and intermetallics with an average coefficient of linear expansion lower than $10.10^{-6}$ m per degree Celsius; and said second materials are selected from a group of materials consisting of materials with higher coefficients of expansion, including INC0718 nickel-based alloys, RENE77 and derivatives thereof each of which have an average coefficient of linear expansion of approximately $15.10^{-6}$ m per degree Celsius.

3. The stator of claim 1 which comprises a housing and a casing for supporting a shroud, said casing defining a chamber for the upstream ventilation and a chamber for the downstream ventilation, wherein the housing has an unbroken annular structure around a circumference in front of the two chambers.

4. The stator of claim 3 wherein said casing comprises rings that extend to constitute an unbroken assembly in front of the first section of the shroud and in front of the second section of the shroud.

5. The stator of claim 4 wherein the rings of the casing in front of the second section of the shroud are, respectively, connected to annular assemblies of juxtaposed first and second sectors of the shroud and wherein said first sectors comprise a pair of concentric lips at one end, said lips gripping a lip of an opposite end of sectors of an adjoining assembly and a lip of a ring of the casing connected to said adjoining annular assembly.

6. The stator of claim 3 wherein the stator comprises rings and the casing in front of the first section of the shroud include rings having protuberances that extend between the rings of the stator and that also define the gas flow jet, wherein the shroud comprises rings which are interlocked between the protuberances.

7. The stator of claim 1 which comprises flexible tabs for connecting said sectors together.

8. The stator of claim 1 which comprises a rotor having first and second sections located in front of the sections of the shroud and which are made of the first material and second material, respectively.

* * * * *